US006811893B2

(12) United States Patent
Wakayama et al.

(10) Patent No.: US 6,811,893 B2
(45) Date of Patent: Nov. 2, 2004

(54) ALUMINUM PLATE WITH THERMOPLASTIC RESIN COATING AND FORMED ARTICLE COMPRISING THE SAME

(75) Inventors: Yoshio Wakayama, Shiga (JP); Keitaro Yamaguchi, Shizuoka (JP); Nobuhiro Sakata, Shiga (JP)

(73) Assignees: Mitsubishi Plastics, Inc., Tokyo (JP); Mitsubishi Aluminum Co., Ltd., Tokyo (JP)

( * ) Notice: Subject to any disclaimer, the term of this patent is extended or adjusted under 35 U.S.C. 154(b) by 0 days.

(21) Appl. No.: 10/333,628

(22) PCT Filed: Jul. 30, 2001

(86) PCT No.: PCT/JP01/06571

§ 371 (c)(1),
(2), (4) Date: May 13, 2003

(87) PCT Pub. No.: WO02/10478

PCT Pub. Date: Feb. 7, 2002

(65) Prior Publication Data

US 2003/0180555 A1 Sep. 25, 2003

(30) Foreign Application Priority Data

Jul. 31, 2000 (JP) ..... 2000-231819
Sep. 8, 2000 (JP) ..... 2000-272492

(51) Int. Cl.[7] ..... B32B 15/00; B32B 15/04; B32B 15/08; B32B 15/20

(52) U.S. Cl. ..... 428/650; 428/654; 428/640; 428/457; 428/626; 428/341; 428/336; 428/448; 428/458; 428/472.2

(58) Field of Search ..... 428/650, 654, 428/639, 640, 457, 472.2, 458, 460, 461, 448, 626, 336; 29/25.03, 17.2, 17.3; 307/109

(56) References Cited

U.S. PATENT DOCUMENTS

| | | | | | |
|---|---|---|---|---|---|
| 5,024,891 | A | * | 6/1991 | Yoshiga et al. | 428/414 |
| 5,589,275 | A | * | 12/1996 | Breitler et al. | 428/458 |
| 6,242,131 | B1 | * | 6/2001 | Noh | 429/185 |
| 6,254,976 | B1 | * | 7/2001 | Ono | 428/304.4 |
| 2002/0009606 | A1 | * | 1/2002 | Yamaguchi | 428/472.2 |

FOREIGN PATENT DOCUMENTS

| | | |
|---|---|---|
| JP | 64-066030 | 3/1989 |
| JP | 01-238931 | 9/1989 |
| JP | 02-018043 | 1/1990 |
| JP | 03-002036 | 1/1991 |
| JP | 11-207860 | 8/1999 |
| JP | 11-245330 | 9/1999 |

* cited by examiner

*Primary Examiner*—Michael La Villa
(74) *Attorney, Agent, or Firm*—Wenderoth, Lind & Ponack, L.L.P.

(57) ABSTRACT

A thermoplastic resin-coated aluminum plate is provided which is less liable to develop ply separation or cracks in a resin coating film during drawing or ironing and on which the resin coating film is less likely to peel off the aluminum plate. A semi-non-porous anodized film is formed on at least one side of the aluminum plate, a coating layer is formed on the semi-non-porous anodized film, and a thermoplastic resin coating film is formed on the coating layer.

7 Claims, No Drawings

ALUMINUM PLATE WITH THERMOPLASTIC RESIN COATING AND FORMED ARTICLE COMPRISING THE SAME

TECHNICAL FIELD TO WHICH THE INVENTION BELONGS

This invention relates to a thermoplastic resin-coated aluminum plate and articles formed from the same. More specifically, it relates to a thermoplastic resin-coated aluminum plate which is less liable to defect such as ply separation when subjected to drawing, ironing or caulking, ply separation with time, and peeling of the coating film if subjected to heat treatment after working, and which is superior in working adhesion and heat-resistant adhesion after working, and to an article formed from such a thermoplastic resin-coated aluminum plate.

PRIOR ART

Resin-coated metallic plates which have a thermoplastic resin coating film laminated on an aluminum or aluminum alloy plate are used in various fields, making the most of their excellent properties such as workability, corrosion resistance and electrical insulation e.g. for casings of electrolytic aluminum capacitors. In these applications, since such resin-coated metallic plates are formed into end articles, it is required that no peeling, crack or breakage develop in the thermoplastic resin coating film during the forming step. In order to meet these requirements and to obtain thermoplastic resin-coated metallic plates superior in working adhesion, various trials have been made.

For example, there have been proposed a method in which a film of an epoxy resin having a surface analysis spectrum value measured by an X-ray electron spectroscopy below a predetermined value is provided on the surface of a metallic material as a substrate film and a polyamide film is laminated on this film (Japanese patent publication 1-238931), a method in which a coating comprising a fatty acid or hydroxymethyl-substituted phenol is formed as a substrate film on the surface of a metallic material, the coating is subjected to heat treatment at a temperature of 350° C. or above to form a heat-modified film, and a polyamide resin film is laminated on the film (Japanese patent publication 3-2036), and a method in which a polyamide resin having a diffraction strength within a predetermined range by X-ray diffraction is laminated on a metallic plate by melt extrusion (Japanese patent publication 11-245330).

PROBLEMS THE INVENTION TACKLES

Polyamide resin-coated metallic plates manufactured by such methods are less liable to peeling at worked portions in the drawing step, but the adhesion strength at the worked portions lowers as time passes. Thus, in order to prevent the adhesion strength from lowering with time, as proposed in Japanese patent publications 1-66030 and 2-18043, it is necessary to re-melt the film by further heat treatment after forming such as drawing.

Under such circumstances, in an attempt to solve all the above problems, the present inventors have completed the present invention.

1. An object of the present invention is to provide a thermoplastic resin-coated aluminum plate which when it is subjected to ironing or drawing, is less liable to ply separation or crack in the coated resin layer or film, or peeling of the resin coating film off the aluminum plate.
2. Another object is to provide a thermoplastic resin-coated aluminum plate in which even after time has passed after working, the adhesion strength at the worked portions will not lower, and heat treatment after forming is not needed, and which is superior in working adhesion and adhesion after working.
3. A further object is to provide a formed article made from such a thermoplastic resin-coated aluminum plate.

MEANS TO SOLVE THE PROBLEMS

According to the first invention of the present invention, there is provided a thermoplastic resin-coated aluminum plate comprising a semi-non-porous anodized film formed on at least one side of an aluminum plate, a coating layer formed on the semi-non-porous anodized film, and a thermoplastic resin coating film formed on the coating layer.

According to the second invention of the present invention, there is also provided a formed article made from a thermoplastic resin-coated aluminum plate, which is formed by working the thermoplastic resin-coated aluminum plate.

DETAILED DESCRIPTION OF THE PREFERRED EMBODIMENT

Below, the present invention will be described in more detail.

In the thermoplastic resin-coated aluminum plate according to the present invention, aluminum (Al) means pure aluminum and aluminum alloys. Specifically, pure aluminum 1000-family, Al—Mn 3000-family alloys, and Al—Mg 5000-family alloys may be used. The aluminums are not limited to these examples. These aluminums are formed into plates having a thickness of 0.1–2 mm. If the thermoplastic resin-coated aluminum plate is used as an outer casing of an aluminum electrolytic capacitor, a 1000-family or 3000-family is preferable.

The aluminum plate may be one subjected to various tempering treatments or pretreatments such as solution heat treatment and aging treatment. Pretreatment is not particularly limited but may be any treatment which can remove fat and oil adhering to the surface of the aluminum plate and unhomogeneous oxide film on the surface. For example, a method may be employed in which after degreasing treatment with a weakly alkaline degreasing liquid, alkali etching is carried out with an aqueous solution of sodium hydroxide, and followed by desmat treatment in an aqueous solution of nitric acid. After degreasing treatment, pickling may be carried out. Also, etching may be carried out simultaneously with degreasing to roughen the surface to such an extent that the aluminum plate surface will not be colored, to improve the anchoring effect. As etching methods, alkali etching with sodium hydroxide, acid etching with sulfuric acid, hydrofluoric acid, etc., etching by electrolysis in an acidic solution such as nitric acid, etc. may be used.

Next, on at least one side of the aluminum plate subjected to such pretreatment, a semi-non-porous anodized film is formed. By forming it, it is possible to improve adhesion between the aluminum plate and the thermoplastic resin coating. In order to form a semi-non-porous anodized film on the aluminum plate, it may be subjected to anodizing treatment in which it is electrolyzed in an electrolytic solution.

Here, "semi-non-porous" means that the ratio (called porosity) of the total area of pores present in the anodized film coating the surface of the aluminum plate to the total area of the anodized film is 30% or less. If the porosity is 5% or less, the film is called practically non-porous.

The pores are ones formed in the process of growth of the anodized film and extending from the aluminum substrate toward the film surface. Their sizes are 50–2000 angstroms in diameter and 50 angstromes or more in depth. In this invention, the surface of the anodized film was observed under an electron microscope at 100000× magnification to determine the area rate of the pores as the porosity (%). Such an area rate of pores can also be determined by observing the section of the anodized film under a high-magnification transmission electron microscope and the surface of the film. Also, while there exist places where no anodized film is formed at crystals and deposits present in the aluminum alloy and their surroundings, such places are not regarded as pores. Initially, a pore-less state is formed in the anodized film, and during forming of the film, pores are formed. The porosity is calculated from the area of the openings existing in the surface in the stage in which the anodized film has been formed.

The non-porous anodized film can be formed by electrolysis in an electrolytic aqueous solution low in solubility of the anodized film, using aluminum as an anode. Specifically, adipate, malonate, phthalate, silicate, etc. can be used. Using such an electrolyte, it is possible to adjust the porosity relatively low. Also, even if an electrolyte having high solubility of the film such as sulfuric acid or phosphoric acid is used, if electrolysis is stopped in the stage before it becomes porous, i.e. in the stage in which it is changing from non-porous to porous film, it is possible to form a non-porous or semi-non-porous film. If such a high-soluble electrolyte is used, if it is electrolyzed to normal film thickness without paying particular attention to the porosity, it will become a porous film exceeding the predetermined porosity.

The thickness of the semi-non-porous anodized film may be selected within the range of 50–3000 angstroms. If it is less than 50 angstroms, it is difficult to form the film uniformly, so that sufficient adhesion with the thermoplastic resin coating is not obtainable. Also, pin holes may develop and aluminum melt out. On the other hand, if the film thickness exceeds 3000 angstroms, the aluminum surface may present a yellow, purple or white appearance due to light interference by the semi-non-porous anodized film, or cracks tend to develop during forming. This is not preferable from a viewpoint of the appearance of the product and melting out of aluminum. The thickness of the semi-non-porous anodized film is especially preferably 100–2000 angstroms.

The thickness of the semi-non-porous anodized film can be adjusted by adjusting electrolyzing conditions such as the length of time during which the aluminum plate is immersed in an electrolytic solution (electrolyzing time), kind of the electrolytic aqueous solution, concentration of the electrolyte, pH and temperature of the electrolytic aqueous solution, voltage and current density. The elecrolyzing time may be selected within the range of 2–200 seconds, though depending on the electrolyzing conditions.

As the electrolytic solution, one which hardly dissolves the semi-non-porous anodized film formed and which produces a non-porous anodized film would be acceptable. Preferably, an electrolytic aqueous solution may be used in which is dissolved one or two or more electrolytes selected from the group consisting of adipate, succinate, citrate, malonate and silicate, and which is low in film dissolving properties. But it is not limited thereto. The concentration of the electrolyte in the electrolytic aqueous solution is preferably 2–150 g/l. If it is lower than 2 g/l, unevenness tends to develop in the film. On the other hand, if over 150 g/l, the electrolyte hardly dissolves and settling may occur.

The temperature of the electrolytic aqueous solution is preferably 40° C. or over. If lower than 40° C. the solubility of the electrolyte is low, so that the voltage loss due to liquid resistance increases. If above 60° C., heating cost is high. Thus, the temperature of the electrolytic aqueous solution is preferably 40° C.–60° C. In particular, if it is 50–60° C., it is effective in reducing the water content of the non-porous anodized film and thus is particularly preferable. Also, the hydrogen ion concentration (pH) of the electrolytic aqueous solution is preferably within the range of 3–8. If the pH is lower than 3, the anodized film tends to become porous. If it exceeds 8, the film produced may melt or the film forming rate lowers, so that the predetermined thickness cannot be obtained.

In the electrolytic aqueous solution, the aluminum plate is electrolyzed, connected to a power source so as to serve as an anode even if it is continuous or discontinuous. For the cathode, an insoluble conductive material is used. The applied voltage is adjusted according to the thickness of the target film, and is approximately 3–200 V. For electrolysis, a DC current is used. The current density should be about 0.3–10 $A/dm^2$. If it is less than 0.3 $A/dm^2$, a long time is needed for the film formation, so that it is impossible to quickly and continuously electrolyze an aluminum plate in a coil form. On the other hand, if over 10 $A/dm^2$, surface loss such as film burning tends to develop.

Anodizing treatment may be carried out to an aluminum plate subjected to such working as pressing, but is preferably carried out to an unworked aluminum plate after extending it wound in the shape of a coil into an elongated article. It is because this makes it possible to quickly carry out anodizing for a large amount of a raw material aluminum plate.

Water may be contained in the semi-non-porous anodized film. But the water content of the semi-non-porous anodized film is preferably 5 wt % or less. This is because during heating for coating the aluminum plate with a thermoplastic resin film, water is released from the semi-non-porous anodized film, so that the adhesion may deteriorate. Also, electrolytic compounds such as phosphate and adipate may be contained in the semi-non-porous anodized film. The content of such electrolytic compounds is preferably 3 wt % or less. If it exceeds 3 wt %, the adhesion with the thermoplastic resin coating film may lower, or the performance of the product formed from the aluminum plate may be influenced.

The thermoplastic resin-coated aluminum plate according to the present invention has a treated coating layer formed on the semi-non-porous anodized film. The treated coating layer is a coating layer formed by applying one selected from the group consisting of silane coupling agent, epoxy resin, fatty acid and hydroxy-substituted phenol on the semi-non-porous anodized film and drying it.

The silane coupling agent is an organic silicon monomer having two or more reactive groups in one molecule, one of the two reactive groups being a reactive group that chemically binds to inorganic substances (such as glass and metal) and the other being a reactive group that chemically binds to an organic substance (including various synthetic resins). Such reactive groups include vinyl group, amino group, epoxy group and acryl group. The reactive groups that bind to the semi-non-porous anodized film of the aluminum plate, which is an inorganic substance, are not particularly limited, but include methoxy groups, ethoxy groups, silanol groups, etc. The layer of silane coupling agent strongly binds to the aluminum plate by forming an Al—O—Si bond. It exhibits strong binding force with a thermoplastic resin due to reaction of organic functional groups in the silane coupling agent with the resin, so that a strong bonding force is imparted between the aluminum plate and the thermoplastic resin coating film.

As such silane coupling agents, aminosilane coupling agents such as γ-aminopropyl triethoxy silane, N-β (aminoethyl) γ-aminopropyl trimethoxy silane, and N-β (aminoethyl) γ-aminopropyl methyldiethoxy silane; trimethylmethoxy silane, vinyltriethoxysilane, vinyltris (β-methoxy-ethoxy)silane, divinyldimethoxysilane, γ-glycydoxypropyltrimethoxysilane, γ-methacryloxypropyl trimethoxy silane, etc. As silane coupling agents, though not limited thereto, the abovementioned aminosilane coupling agents are more preferable.

The amount of the silane coupling agent applied to the semi-non-porous anodized film on the surface of the aluminum plate is preferably 0.1–1000 mg/m$^2$. If it is less than 0.1 mg/m$^2$, a sufficient bonding strength would not be obtained against the thermoplastic resin coating film. If over 1000 mg/m$^2$, the bonding strength would reach saturation, not proportional to the amount of application. Also, silane coupling tends to occur and this makes handling difficult.

The silane coupling agent on the semi-non-porous anodized film on the surface of the aluminum plate is preferably applied after diluting it with a volatile solvent such as alcohol. The manner of application is not particularly limited. Any known method may be used such as roll coating, spray coating, bar coating or dipping. After application, it is preferably dried by volatilizing and sputtering the solvent.

As the epoxy resin, besides a bisphenol A type epoxy resin obtained by reacting epichlorhydrin with bisphenol A, a bisphenol F type epoxy resin, and a bisphenol AD type epoxy resin, a novolac type epoxy resin, olesocresol novolac type epoxy resin, cycloaliphatic epoxy resin, glycerin triether type epoxy resin, and polyglycidyl amine type epoxy resin can be used. For such an epoxy resin, its molecular weight is preferably 330–3000 and its epoxy equivalent amount is preferably 150–3000.

The fatty acid may be a lower fatty acid or a higher fatty acid and it may be palmitic acid, stearic acid, oleic acid, lauric acid, myristic acid, behenic acid, etc. Also, as the hydroxy-substituted phenol, salicyl alcohol, o-hydroxymethyl-P-cresol, etc. may be used.

The epoxy resin, fatty acid or hydroxy-substituted phenol may be applied on the semi-non-porous anodized film singly or after diluting with a volatile solvent such as methylethylketone, acetone, trichlene or alcohol. Also, for the purpose of preventing pollution of the work environment, effective components such as epoxy resin, fatty acid or hydroxy-substituted phenol may be applied in the form of an aqueous emulsion obtained by diluting with an aqueous diluent. In diluting, the concentration of the effective components is preferably selected from the range of 1–60 wt %.

As an application method, any ordinary coating method such as a gravure-roll method, reverse-roll method, kiss-roll method, air-knife coating, roll coating, spray coating, bar coating or dip coating may be used. As a drying method, they may be left for several hours at normal temperature, or they may be baked at a high temperature of e.g. 80–180° C. If the latter method is used, it is efficient to carry it out on the same line as the below-described heat treatment at 250° C. or over. Also, it is possible to simultaneously carry out the bake drying and the heat treatment at 250° C. or over.

The thickness of the coating formed of epoxy resin, fatty acid, or hydroxy-substituted phenol is preferably about 0.01–10 μm. Also, the coating is preferably heat-treated at a temperature of 250° C. or over into a heat-modified coating. This increases the bond strength between the semi-non-porous anodized film formed on the surface of the aluminum plate and the thermoplastic resin coating film. The reason why the bond strength increases by heat treatment at such a temperature is not clearly known, but this is presumably because the epoxy resin, fatty acid or hydroxy-substituted phenol is chemically modified to exhibit a strong binding force with the aluminum plate and the thermoplastic resin coating. If the heat treatment temperature is less than 250° C., heat modification will not be sufficient to exhibit a good adhesion when a thermoplastic resin coating film is laminated on the heat-modified coating.

For the thermoplastic resin-coated aluminum plate according to the present invention, a thermoplastic resin coating film is formed on the treated coating layer. As the thermoplastic resin, it is not specifically limited but the following may be used: polyester resins such as a copolymer polyester resin obtained by replacing part of a terephthalic acid which is an acid component of polyethylene terephthalate, polybutylene terephthalate, ethylene terephthalate or butylene terephthalate with another acid; and a copolymer polyester resin obtained by replacing part of ethylene glycol of ethylene terephthalate or buthylene terephthalate with another alcohol; a resin blend obtained by blending two or more such polyester resins; a polyamide resin such as polyamide 6, polyamide 66, copolymer polyamide 66-6, polyamide 6-10, polyamide 7, polyamide 12, polymetaxylylene adipamide; polyolefins such as polyethylene, polypropylene, ethylene-propylene copolymer resin; polyolefinic resins obtained by acid-modifying using maleic acid; polycarbonate: polyethylene naphthalate; fluorine resin.

The coating film comprising such thermoplastic resins may be of a single layer or a multilayered one containing two or more layers of different resin coating films. The coating film comprising such thermoplastic resins may be a non-stretched, non-oriented coating film or a coating film stretched and oriented in one or two directions. The thickness of the coating film comprising a thermoplastic resin is preferably 5–100 μm. If it is less than 5 μm, it is difficult to laminate it uniformly on the surface of the aluminum plate. Further, when the thermoplastic resin-coated aluminum plate obtained is subjected to drawing or ironing, cracks tend to develop in the resin layer, thus decreasing the performance. On the other hand, if it exceeds 100 μm, it is economically disadvantageous. In order to improve adhesion and wettability, the coating film comprising thermoplastic resin should be subjected to surface treatment such as corona treatment, coating treatment or flame treatment.

The method of manufacturing a thermoplastic resin-coated aluminum plate according to the present invention is not particularly limited, but it may be manufactured by an extrusion method in which a molten thermoplastic resin is directly extruded onto the surface of the aluminum plate in a film-like shape from an extruder equipped with a die such as a T-die or an I-die to laminate it, or by a film laminating method in which a thermoplastic resin film formed beforehand by an inflation method, T-die method, calender method, etc. is brought into abutment with the aluminum plate, which has been heated to or over the melting point of the resin, and the film is laminated by sandwiching them between a pair of laminate rolls. The manufacturing method is not limited to the abovesaid ones.

The thermoplastic resin-covered aluminum plate is formed by any desired method into a formed product. As examples of such forming methods, press forming methods such as drawing method, drawing-re-drawing method, drawing-pulling-bending-stretching method and drawing-ironing method.

The thermoplastic resin-coated aluminum plate according to the present invention can be used as wall surface materials, partitioning plate materials, and design plate materials for buildings. Also, formed products made of the thermoplastic resin-coated aluminum plate can be used e.g. as an outer casing of an aluminum electrolytic capacitor.

EXAMPLES

Hereinbelow, the present invention will be described below specifically by Examples and Comparative Examples. The present invention is not limited to the below-described Examples.

The thermoplastic resin-coated aluminum plates prepared in the below-described methods were evaluated in the below-described methods.

(a) Porosity: Thermoplastic resin-coated aluminum plates were magnified 100 thousand times under a scanning electron microscope and 10 arbitrary locations were observed to calculate the total area of the pores present on the surface of the aluminum plate, and the porosity was calculated by dividing the total area of the pores by the entire area of the aluminum plate.

(b) Pressability: For each coated plate specimen, 7-step drawing was carried out using a progressive drawing machine so that container outer surfaces would be resin layers to form 100 cylindrical containers (ironing rate: 20%) 10 mm dia.×20 mm high, and the peeling between layers was visually observed. Those having no ply separation at all were determined as non-defectives and the evaluation results were shown in terms of non-defective rate (%).

(c) Caulkability: While turning the cylindrical containers 10 mm dia.×20 mm high at a revolving speed of 100 rpm, a disk-like caulking roller (having a semicircular side with a radius of 1.5 mm) was pressed to caulk them to a diameter of 7.5 mm (diameter change rate=25%), and the peel state between layers was visually observed. The 100 containers were checked and those having no ply separation were determined as non-defectives, and the evaluation results were shown in terms of non-defective rate (%).

(d) Change with time 10 days later: For the 100 containers used in the "caulkability test", the peel state between layers of the container after 10 days had passed since working was checked, those having no ply separation were determined as non-defectives, and the evaluation results were shown in terms of non-defective rate (%).

(e) Comprehensive evaluation: Those of passable quality in all of the items (a)–(d) were determined as good "○" and those not passable even in one item were determined as bad "x". Those not bad but of lower quality than passable ones were marked "Δ".

Example 1

<Preparation of Thermoplastic Resin-Coated Aluminum Plate>

The surface of an aluminum (under JIS1100) plate having a thickness of 0.3 mm was subjected to etching in a 10% sodium hydroxide aqueous solution at 50° C. for 30 seconds, neutralization in a 10% nitric acid aqueous solution and rinsing for 10 seconds. Next, the aluminum plate was subjected to electrolyzing for 120 seconds in a 2% adipic acid ammonium aqueous solution with the electrolyzing voltage of 7 V and current density of 3.0 A/dm$^2$ to form a non-porous anodized film having a thickness of 100 angstromes on the surface of the aluminum plate.

After the electrolyzing treatment, the aluminum plate was rinsed for 30 seconds and dried at a temperature of 120° C. On the non-porous anodized film of the aluminum plate, an epoxy silane coupling agent was applied at a rate of 900 mg/m$^2$. After drying, the aluminum plate was heated to a temperature of 250° C., and a film of polyamide 6 having a thickness of 15 $\mu$m was laminated on the surface on which was applied the coupling agent to obtain a polyamide resin-coated aluminum plate.

<Evaluation of the Product>

For the polyamide resin-coated aluminum plate thus obtained, the evaluation results by the above method are shown in Table 1.

Example 2

Except that the electrolyzing voltage was changed to 70 V, elecrolyzing was carried out in the same manner as in the Example 1 to form a non-porous anodized film having a thickness of 1000 angstroms on the surface of the aluminum plate. On the non-porous anodized film, an amino silane coupling agent was applied at a rate of 50 mg/m$^2$. After drying, the aluminum plate was heated to a temperature of 250° C. and a film of polyamide 6 having a thickness of 15 $\mu$m was laminated on the surface on which was applied the coupling agent, in the same manner as in Example 1 to obtain a polyamide resin-coated aluminum plate. For the polyamide resin-coated aluminum plate obtained, the evaluation results are shown in Table 1.

Example 3

Except that an amino silane coupling agent was applied at a rate of 0.1 mg/m$^2$ on the non-porous anodized film having a thickness of 1000 angstroms, a film of polyamide 6 having a thickness of 15 $\mu$m was laminated on the surface on which was applied the coupling agent in the same manner as in Example 2 to obtain a polyamide resin-coated aluminum plate. For the polyamide resin-coated aluminum plate obtained, the evaluation results are shown in Table 1.

Example 4

Except that the electrolyte was changed to a 2% phosphate-ammonium aqueous solution and the electrolyzing voltage was changed to 140 V to form a non-porous anodized film having a thickness of 2000 angstroms, an epoxy silane coupling agent was applied at a rate of 50 mg/m$^2$ in the same manner as in the Example 1 and a polyethylene terephthalate film was laminated to obtain a polyester resin-coated aluminum plate. For the resin-coated aluminum plate obtained, the evaluation results are shown in Table 1.

Example 5

Except that the electrolyte was changed to a 2% sodium silicate aqueous solution and the electrolyzing voltage was changed to 200 V to form a non-porous anodized film having a thickness of 2800 angstroms, a coupling agent was applied and a film of polyamide 6 was laminated in the same manner as in Example 2 to obtain a polyamide resin-coated aluminum plate. For the resin-coated aluminum plate obtained, the evaluation results are shown in Table 1.

Example 6

In Example 1, the electrolyte was changed to a 2% adipic acid-ammonium aqueous solution and the electrolyzing voltage was changed to 180 V to form a non-porous anodized film having a thickness of 2500 angstroms. On the non-porous anodized film, an acrylic silane coupling agent was applied at a rate of 50 mg/m$^2$. After drying, the aluminum plate was heated to a temperature of 250° C., and a maleic anhydride-modified polypropylene film having a thickness of 15 $\mu$m was laminated on the surface on which was applied the coupling agent to obtain a polypropylene resin-coated aluminum plate. For the aluminum plate obtained, the evaluation results are shown in Table 1.

Comparative Example 1

Except that the electrolyzing voltage was changed to 3 V, electrolyzing was carried out in the same manner as in Example 1 to form a non-porous anodized film having a thickness of 40 angstroms on the surface of an aluminum plate. A film of polyamide 6 having a thickness of 15 $\mu$m was laminated in the same manner as in Example 1 to obtain a polyamide resin-coated aluminum plate. The aluminum plate obtained was evaluated. The results are shown in Table 2.

Comparative Example 2

The surface of an aluminum (JIS1100) plate having a thickness of 0.3 mm was subjected to etching in the same manner as in Example 1. Thereafter, it was treated with chromate phosphate with the chrome amount after drying set at 20 mg/m$^2$. On the chromate phosphate-treated surface, an amino silane coupling agent was applied at a rate of 50 mg/m$^2$. After drying, a film of polyamide 6 having a thickness of 15 $\mu$m was laminated on the surface on which was applied the coupling agent, in the same manner as in Example 1 to obtain a polyamide resin-coated aluminum plate. For the polyamide resin-coated aluminum plate obtained, the evaluation results are shown in Table 2.

Comparative Example 3

Except that the amount of the amino silane coupling agent was changed to 0.07 mg/m$^2$, in the same procedure as in Example 2, after drying a film of polyamide 6 having a thickness of 15 $\mu$m was laminated on the surface on which was applied the coupling agent, in the same manner as in Example 2 to obtain a polyamide resin-coated aluminum plate. For the aluminum plate obtained, the evaluation results are shown in Table 3.

Comparative Example 4

In Example 2, electrolyzing treatment was carried out for 8 seconds at a temperature of 20° C. with the electrolyte changed to 10% sulfuric acid aqueous solution and the current density to 1.0 A/dm$^2$ to form an anodized film having a thickness of 3000 angstroms on the surface of the aluminum plate. The porosity of the anodized film was 30% or over. On the anodized film, an amino silane coupling agent was applied at a rate of 50 mg/m$^2$. After drying, a film of polyamide 6 having a thickness of 15 $\mu$m was laminated on the surface on which was applied the coupling agent, in the same procedure as in Example 2 to obtain a polyamide resin-coated aluminum plate. For the aluminum plate obtained, the evaluation results are shown in Table 2.

From Tables 1 and 2, the following is apparent.

(1) The resin-coated aluminum plates which is non-porous with the porosity of 5% or less and which has an anodized film having a thickness of 50 to 3000 angstroms, a silane coupling agent applied by an amount of 0.1–1000 mg/m$^2$ on the anodized film, and a coating film of a thermoplastic resin on the layer of the silane coupling agent are superior in pressability and caulkability, and even when 10 days had passed since working, lowering of the adhesion strength at the worked portions or ply separation did not occur (see Examples 1–6).

(2) Even if it is non-porous with the porosity of 1%, in the case of a thin anodized film having a thickness of 40 angstroms, it is inferior in press workability and caulkability and when 10 days had passed since working, the adhesion strength at the worked portions lowered and ply separation occurred (see Comparative Example 1).

(3) Also, in the case in which the surface-treated film is not a non-porous anodized film formed by chromate phosphate treatment or if it is an anodized film but not semi-non-porous with the porosity of 30% or more, although pressing offers no problem, it is inferior in caulkability and the adhesion strength at the worked portions lowers with time, so that ply separation develops (see Comparative Examples 2 and 4).

(4) Even if it is non-porous with the porosity at 1% and the anodized film has a thickness of 50–3000 angstroms, if the amount of the silane coupling agent is less than 0.1 mg/m$^2$, it is inferior in pressability and caulkability, and the adhesion strength at the worked portions lowers with time, so that ply separation occurs (see Comparative Example 3).

Next, description is made about Examples 7–13 and Comparative Examples 5–8. Measurement and judgment of caulkability were made by the following method. Other measurements and judgments are as mentioned above.

(c') Caulkability: While turning the cylindrical containers 10 mm diameter=20 mm high at a revolving speed of 100 rpm, a disk-like caulking roller (having a semicircular side of R=1.5 mm) was pressed against it to caulk them so that the diameter would be 8 mm (diameter change rate=20%), and the peel state between layers was visually observed. Confirmation was made for the 100 containers. Those having no ply separation were determined as non-defectives, and the evaluation results are shown in terms of non-defective rate (%).

Example 7

<Preparation of Thermoplastic Resin-Coated Aluminum Plate>

After the surface of an aluminum plate (alloy number: A1100P H24) having a thickness of 0.3 mm had been subjected to etching in a 10% sodium hydroxide aqueous solution at 50° C. for 30 seconds, it was subjected to neutralization in a 10% nitric acid aqueous solution and rinsing for 10 seconds. Next, the aluminum plate was subjected to electrolyzing for 120 seconds in 2% adipic acid ammonium aqueous solution with the electrolyzing voltage at 7 V and current density at 3.0 A/dm$^2$ to form a non-porous anodized film having a thickness of 100 angstroms on the surface of the aluminum plate. After electrolyzing, the aluminum plate was rinsed for 30 seconds and dried at a temperature of 120° C. On the non-porous anodized film of the aluminum plate, bisphenol A type epoxy resin (molecular weight: 380, epoxy equivalent amount: 180–200) dissolved in methylethylketone was applied with a roll-coater and dried by leaving it for 6 hours at normal temperature to form a coating having a thickness of 1 μm. This coating was heat-treated at 350° C. into a heat-modified coating. On the heat-modified coating, a coating film of polyamide 6 having a thickness of 15 μm was laminated to obtain a polyamide resin-coated aluminum plate.

<Evaluation of the Product>

For the polyamide resin-coated aluminum plate obtained, the evaluation results are shown in Table 3.

Example 8

Except that the electrolyzing voltage was changed to 70 V and the thickness of the non-porous anodized film was changed to 1000 angstroms, a polyamide resin-coated aluminum plate was obtained in the same procedure as in Example 7. For the aluminum plate obtained, the evaluation results are shown in Table 3.

Example 9

Except that the electrolyzing voltage was changed to 70 V, the thickness of the non-porous anodized film was changed to 1000 angstroms, and the coating formed on the non-porous anodized film was changed to a coating comprising oleic acid, a polyamide resin-coated aluminum plate was obtained in the same procedure as in Example 7. For the aluminum plate obtained, the evaluation results are shown in Table 3.

Example 10

Except that the electrolytic aqueous solution was changed to a 2% phosphate-ammonium aqueous solution, the electrolyzing voltage was changed to 140 V, the thickness of the non-porous anodized film was changed to 2000 angstroms, the thickness of the coating comprising the bisphenol A type epoxy resin was changed to 0.1 μm, and the heat treatment temperature was changed to 270° C., a polyamide resin-coated aluminum plate was obtained in the same procedure as in Example 7. For the aluminum plate obtained, the evaluation results are shown in Table 3.

Example 11

Except that the electrolytic aqueous solution was changed to a 2% sodium silicate aqueous solution, the electrolyzing voltage was changed to 200 V, and the thickness of the non-porous anodized film was changed to 2800 angstroms, a polyamide resin-coated aluminum plate was obtained in the same procedure as in Example 7. For the aluminum plate obtained, the evaluation results are shown in Table 3.

Example 12

Except that the electrolytic aqueous solution was changed to a 2% adipic acid-ammonium aqueous solution, the electrolyzing voltage was changed to 180 V, and the thickness of the non-porous anodized film was changed to 2500 angstroms, a polyamide resin-coated aluminum plate was obtained in the same procedure as in Example 7. For the aluminum plate obtained, the evaluation results are shown in Table 3.

Example 13

Except that the coating formed on the non-porous anodized film was changed to a coating comprising salicyl alcohol, a polyamide resin-coated aluminum plate was obtained in the same procedure as in Example 7. For the aluminum plate obtained, the evaluation results are shown in Table 3.

Comparative Example 5

Except that the electrolyzing voltage was changed to 3 V and the thickness of the non-porous anodized film was changed to 40 angstroms, a polyamide resin-coated aluminum plate was obtained in the same procedure as in Example 7. For the aluminum plate obtained, the evaluation results are shown in Table 4.

Comparative Example 6

Except that the coating formed on the surface of the aluminum plate was changed to a coating formed by treating with chromate phosphate (amount of chrome after drying: 20 mg/m$^2$), a polyamide resin-coated aluminum plate was obtained in the same procedure as in Example 7. For the aluminum plate obtained, the evaluation results are shown in Table 4.

Comparative Example 7

Except that the electrolyzing voltage was changed to 70 V, the thickness of the non-porous anodized film was changed to 1000 angstroms, and the heat treatment temperature of the film comprising bisphenol A type epoxy resin was changed to 200° C., a polyamide resin-coated aluminum plate was obtained in the same procedure as in Example 7. For the aluminum plate obtained, the evaluation results are shown in Table 4.

Comparative Example 8

Except that the coating formed on the surface of the aluminum plate was changed to an anodized film having a thickness of 3000 angstroms and a porosity of 30% or over, a polyamide resin-coated aluminum plate was obtained in the same procedure as in Example 7. The anodized film was formed by subjecting the surface of the aluminum plate to electrolyzing for 8 seconds with the electrolyzing voltage at 16 V and current density of 1.0 A/dm$^2$ in a 10% sulfuric acid aqueous solution at 20° C. For the aluminum plate obtained, the evaluation results are shown in Table 4.

From Tables 3 and 4, the following is apparent.

(1) The thermoplastic resin-coated aluminum plates in which a non-porous anodized film having a thickness of 50–3000 angstroms and having a porosity of 5% or less is formed on at least one side of the aluminum plate, a coating is formed on the non-porous anodized film by applying one selected from the group consisting of epoxy resins, fatty acids, hydroxy-substituted phenols, and a thermoplastic resin coating film is formed on the coating are superior in pressability and caulkability, and even when 10 days had passed since working, lowering of the adhesion strength at the worked portions or ply separation will not occur (see Examples 7–13).

(2) Even if the porosity is 5% or under (non-porous), if the anodized film is thin with a thickness of 40 angstroms, the plate is inferior in pressability and caulkability and when 10 days had passed since working, the adhesion strength at the worked portions lowers and ply separation occurs (see Comparative Example 5).

(3) Also, in the case the coating formed on the surface of the aluminum plate is formed by treating with chromate phosphate (namely not an anodized film) or it is an anodized film but has a porosity of 5% or over (not non-porous), although pressing is no problem, the plate will be inferior in caulkability and the adhesion strength at the worked portions lowers with time, so that ply separation develops (see Comparative Examples 6 and 8).

(4) Even if the porosity is 5% or less (non-porous) and the thickness of the anodized film is 50–3000 angstroms, if the heat treatment temperature of the coating formed by applying an epoxy resin is lower than 250° C., the plate will be inferior in pressability and caulkability, and the adhesion strength at the worked portions lowers with time, so that ply separation occurs (see Comparative Example 7).

Examples 14–16

Except that the electrolyzing voltage was changed to 70 V, elecrolyzing was carried out in the same procedure as in Example 1 to form a non-porous anodized film having a thickness of 1000 angstroms on the surface of the aluminum plate. On the non-porous anodized film, silane coupling agents shown in Table 5 were applied at a rate of 50 mg/m$^2$. After drying, the aluminum plate was heated to a temperature of 250° C., and a film of polyamide 6 having a thickness of 15 $\mu$m was laminated on the surface on which was applied the coupling agents, in the same procedure as in Example 1 to obtain polyamide resin-coated aluminum plates. The aluminum plates obtained were evaluated by the above method and the following peeling strength test. The evaluation results are shown in Table 5.

(Peeling Strength Test)

Specimens are prepared by rolling thermoplastic resin-coated aluminum plates to 40% of the original thickness. The peeling strength is the maximum load required to peel the thermoplastic resin coating by a width of 20 mm in direction of 180 degrees at a rate of 50 mm/min.

From Table 5, the following is apparent.

The resin-coated aluminum plates in which a silane coupling agent was applied at a rate of 50 mg/m$^2$ on an aluminum plate formed with a non-porous anodized film having the porosity of 2% or less and a thickness of 1000 angstroms, and in which a coating film of thermoplastic resin is formed on the layer of silane coupling agent are superior in pressability and caulkability, and even when 10 days had passed since working, lowering of the adhesion strength at the worked portions or ply separation do not occur. For the peel strength, aminosilane coupling agents showed the highest values. Thus the effect is high.

Example 17

After the surface of an aluminum plate (alloy number: A1100P H24) having a thickness of 0.3 mm had been subjected to etching in a 10% sodium hydroxide aqueous solution at 50° C. for 30 seconds, neutralizing in a 10% nitric acid aqueous solution and rinsing for 10 seconds. Next, the aluminum plate was immersed in a 10% sulfuric acid solution and subjected to electrolyzing at 20° C. for 10 seconds with the electrolyzing voltage at 15 V and current density at 1.0 A/dm$^2$ in 5% sulfuric acid to form a semi-non-porous anodized film having a thickness of 300 angstroms on the surface of the aluminum plate. The porosity of the film was 25%. After electrolyzing, the aluminum plate was rinsed for 30 seconds and dried at a temperature of 120° C. On the non-porous anodized film of the aluminum plate, an aminosilane coupling agent was applied at a rate of 50 mg/m$^2$ and dried. The aluminum plate was heated to 250° C. On the surface on which a coupling agent was applied, a polyethylene terephthalate film 15 $\mu$m thick was laminated to obtain a polyester resin-coated aluminum plate. For the aluminum plate obtained, the evaluation results are shown in Table 6.

Effects of the Invention

The present invention has the following advantages and the value of its industrial use is extremely high.

1. The thermoplastic resin-coated aluminum plate according to the present invention is less liable to develop ply separation or cracks in the coating resin layer when drawing or ironing. Also, the resin coating film is less likely to peel off the aluminum plate.
2. It is superior in working adhesion and adhesion after working. Thus, even when time passes after working, lowering of the adhesion strength at the worked portions will not occur. Thus, no heat treatment after forming as proposed in Japanese patent publications 1-66030 and 2-18043 is necessary. Thus the manufacturing steps are simplified.
3. It is extremely useful for the manufacture of formed articles such as outer casing for aluminum electrolytic capacitors.

TABLE 1

| | Example 1 | Example 2 | Example 3 | Example 4 | Example 5 | Example 6 |
|---|---|---|---|---|---|---|
| porosity | 1% or less | 2% or less | 2% or less | 1% or less | 1% or less | 1% or less |
| film thickness (Å) | 100 | 1000 | 1000 | 2000 | 2800 | 2500 |
| kind of silane coupling agent | epoxy silane family | amino silane family | amino silane family | epoxy silane family | amino silane family | acryl silane family |
| amount applied (mg/m$^2$) | 900 | 50 | 0.1 | 50 | 50 | 50 |
| kind of thermoplastic resin | polyamide | polyamide | polyamide | polyester | polyamide | maleic anhydrous modified polypropylene |
| pressability (%) | 100 | 100 | 100 | 100 | 100 | 100 |
| caulkability (%) | 100 | 100 | 100 | 100 | 100 | 100 |
| change with 10 days (%) | 100 | 100 | 100 | 100 | 100 | 100 |
| evaluation | ○ | ○ | ○ | ○ | ○ | ○ |

For the silane coupling agents, the following is used.
epoxy silane family: γ-glycydoxypropyltriethoxysilane
amino silane family: γ-aminopropyltriethoxysilane
acryl silane family : 3-methacryloxypropyltrimethoxysilane

TABLE 2

| | Comp. Ex. 1 | Comp. Ex. 2 | Comp. Ex. 3 | Comp. Ex. 4 |
|---|---|---|---|---|
| porosity | 1% or less | treated with chromate phosphate | 2% or less | 30% or less |
| film thickness (Å) | 40 | 20 (mg/m$^2$) | 1000 | 3000 |
| kind of silane coupling agent | epoxy silane family | amino silane family | amino silane family | amino silane family |
| amount applied (mg/m$^2$) | 900 | 100 | 0.07 | 50 |
| kind of thermoplastic resin | polyamide 6 | polyamide 6 | polyamide 6 | polyamide 6 |
| pressability (%) | 70 | 100 | 80 | 50 |
| caulkability (%) | 40 | 80 | 60 | 30 |
| change with 10 days (%) | 0 | 20 | 0 | 0 |
| evaluation | x | x | x | x |

TABLE 3

| | Example 7 | Example 8 | Example 9 | Example 10 | Example 11 | Example 12 | Example 13 |
|---|---|---|---|---|---|---|---|
| porosity | 1% or less | 2% or less | 2% or less | 1% or less | 1% or less | 1% or less | 1% or less |
| thickness of anodized film (Å) | 100 | 1000 | 1000 | 2000 | 2800 | 2500 | 100 |
| kind of heat-modified coating | bisphenol type A epoxy resin | bisphenol type A epoxy resin | oleic acid | bisphenol type A epoxy resin | bisphenol type A epoxy resin | bisphenol type A epoxy resin | salicylic alcohol |
| amount applied (mg/m$^2$) | 350 | 350 | 350 | 270 | 350 | 350 | 350 |
| kind of thermoplastic resin | polyamide 6 | polyamide 6 | polyamide 6 | polyamide 6 | polyamide 6 | polyamide 6 | polyamide 6 |
| pressability (%) | 100 | 100 | 100 | 100 | 100 | 100 | 100 |
| caulkability (%) | 100 | 100 | 100 | 100 | 100 | 100 | 100 |
| change with 10 days (%) | 100 | 100 | 100 | 100 | 100 | 100 | 100 |
| evaluation | ○ | ○ | ○ | ○ | ○ | ○ | ○ |

TABLE 4

| | Comp. Ex. 5 | Comp. Ex. 6 | Comp. Ex. 7 | Comp. Ex. 8 |
|---|---|---|---|---|
| porosity | 1% or less | treated with chromate phosphate | 2% or less | 30% or less |
| thickness of anodized film (Å) | 40 | 20 (mg/m$^2$) | 1000 | 3000 |
| kind of heat-modified coating | bisphenol type A epoxy resin | bisphenol type A epoxy resin | bisphenol type A epoxy resin | bisphenol type A epoxy resin |
| amount applied (mg/m$^2$) | 350 | 350 | 200 | 350 |
| kind of thermoplastic resin | polyamide 6 | polyamide 6 | polyamide 6 | polyamide 6 |
| pressability (%) | 60 | 100 | 50 | 60 |
| caulkability (%) | 40 | 30 | 0 | 10 |
| change with 10 days (%) | 0 | 30 | 0 | 0 |
| evaluation | x | x | x | x |

TABLE 5

| | Example 14 | Example 15 | Example 16 |
|---|---|---|---|
| porosity | 2% or less | 2% or less | 2% or less |
| film thickness (Å) | 1000 | 1000 | 1000 |
| kind of silane coupling agent | amino silane family | epoxy silane family | acryl silane family |
| amount applied (mg/m$^2$) | 50 | 50 | 50 |
| kind of thermoplastic resin | polyamide 6 | polyamide 6 | polyamide 6 |
| peeling strength (N/20 mm wide) | 4.2 | 3.6 | 3.5 |

TABLE 5-continued

| | Example 14 | Example 15 | Example 16 |
|---|---|---|---|
| pressability (%) | 100 | 100 | 100 |
| caulkability (%) | 100 | 100 | 100 |
| change with 10 days (%) | 100 | 100 | 100 |
| evaluation | ○ | ○ | ○ |

For the silane coupling agents, the following is used.
epoxy silane family: γ-glycydoxypropyltriethoxysilane
amino silane family: γ-aminopropyltriethoxysilane
acryl silane family: 3-methacryloxypropyltrimethoxysilane

TABLE 6

| | Example 17 |
|---|---|
| porosity | 25% |
| film thickness (Å) | 300 |
| kind of silane coupling agent | amino silane family |
| amount applied ($mg/m^2$) | 50 |
| kind of thermoplastic resin | polyester |
| pressability (%) | 100 |
| caulkability (%) | 80 |
| change with 10 days (%) | 50 |
| evaluation | Δ |

For the silane coupling agents, the following is used.
amino silane family: γ-aminopropyltriethoxysilane

What is claimed is:

1. A thermoplastic resin-coated aluminum plate comprising a practically non-porous anodized film having a porosity of not more than 5%, and having a thickness of 50–3000 angstroms, or a semi-non-porous anodized film having a porosity over 5% and not more than 30%, and having a thickness of 50–3000 angstroms, said practically non-porous or semi-non-porous anodized film being formed on at least one side of an aluminum plate, a coating layer formed by applying one selected from the group consisting of silane coupling agents, fatty acids, and hydroxy-substituted phenols on said non-porous or semi-non-porous anodized film, and a thermoplastic resin coating film formed on said coating layer.

2. A formed article made from a thermoplastic resin-coated aluminum plate, which is formed by working the thermoplastic resin-coated aluminum plate of claim 1.

3. The thermoplastic resin-coated aluminum plate as claimed in claim 1, wherein said coating layer is formed by applying a silane coupling agent, said silane coupling agent being an amino silane coupling agent and the amount of said silane coupling agent applied is 0.1–1000 $mg/m^2$.

4. The thermoplastic resin-coated aluminum plate of claim 3 wherein said coating layer is formed by applying one member selected from the group consisting of fatty acids and hydroxyl-substituted phenols, and said coating layer being a heat-modified layer which has been heat-treated at 250° C. or over.

5. A formed article made from a thermoplastic resin-coated aluminum plate, which is formed by working the thermoplastic resin-coated aluminum plate of claim 3.

6. The thermoplastic resin-coated aluminum plate as claimed in claim 1, wherein the coating layer is formed by applying one selected from the group consisting of fatty acids and hydroxy-substituted phenols and is a heat-modified coating film formed by heat-treating at 250° C. or higher.

7. A formed article made from the thermoplastic resin-coated aluminum plate of claim 6, which is used as an outer casing for an aluminum electrolytic capacitor.

* * * * *